United States Patent [19]

Popper

[11] 4,155,123

[45] May 22, 1979

[54] DEODORIZING MANUFACTURE FOR THE FOOT USING ION EXCHANGE MATERIAL

[75] Inventor: Karel Popper, Danville, Calif.

[73] Assignee: Paul M. Klein, Jr., Oakland, Calif. ; a part interest

[21] Appl. No.: 626,361

[22] Filed: Oct. 28, 1975

Related U.S. Application Data

[62] Division of Ser. No. 382,208, Aug. 24, 1973, Pat. No. 3,922,723.

[51] Int. Cl.[2] ..... A41B 11/00

[52] U.S. Cl. ..... 2/239; 36/43

[58] Field of Search ..... 2/239, 240, 53, 54, 2/55, 58, 61, 109, 113, 114, DIG. 7, 409; 36/9, 9 A, 43, 44, 71; 8/116.2, 120; 424/76, 79; 21/55; 57/149, 153; 106/15; 128/284, 296

[56] References Cited

U.S. PATENT DOCUMENTS

| | | | |
|---|---|---|---|
| 2,434,830 | 1/1948 | Billins | 2/53 X |
| 2,501,927 | 3/1950 | Block | 424/79 |
| 2,684,321 | 7/1954 | Thurmon et al. | 424/79 |
| 2,838,440 | 6/1968 | Thurmon | 424/79 X |
| 2,919,230 | 12/1959 | Thurmon | 424/79 |
| 2,951,811 | 9/1960 | Lutz et al. | 424/79 X |
| 3,016,327 | 1/1962 | Schmitz et al. | 424/79 |
| 3,308,488 | 3/1967 | Schoonman | 106/15 AF |
| 3,345,341 | 10/1967 | Berry et al. | 117/138.8 N |
| 3,377,249 | 4/1968 | Marco | 8/115.6 |
| 3,567,820 | 3/1971 | Sperti | 424/79 |

OTHER PUBLICATIONS

Guthrie, "Ion Exchange Cottons", Industrial & Engineering Chemistry, vol. 44, No. 9, pp. 2187–2189.

Berch et al., "Wet Soiling of Cotton", Part III, Textile Research Journal, vol. 34, No. 1, pp. 29–34, Jan. '64.

Beninate et al., "Influence of Fiber Swellability in Selected Fabrics," American Dyestuff Reporter, pp. 26–30, Sep. 30, 1963.

*Primary Examiner*—H. Hampton Hunter

*Attorney, Agent, or Firm*—Paul M. Klein, Jr.

[57] ABSTRACT

Deodorizing is accomplished by contacting odorant, such as that exuded by humans, with solid, essentially non-fluid anion exchanger material in substantially extended form. Articles used in the method are typically those worn on the body, such as hose, or those used to envelop or wipe odoriferous substances and contain anion exchange cotton.

5 Claims, 1 Drawing Figure

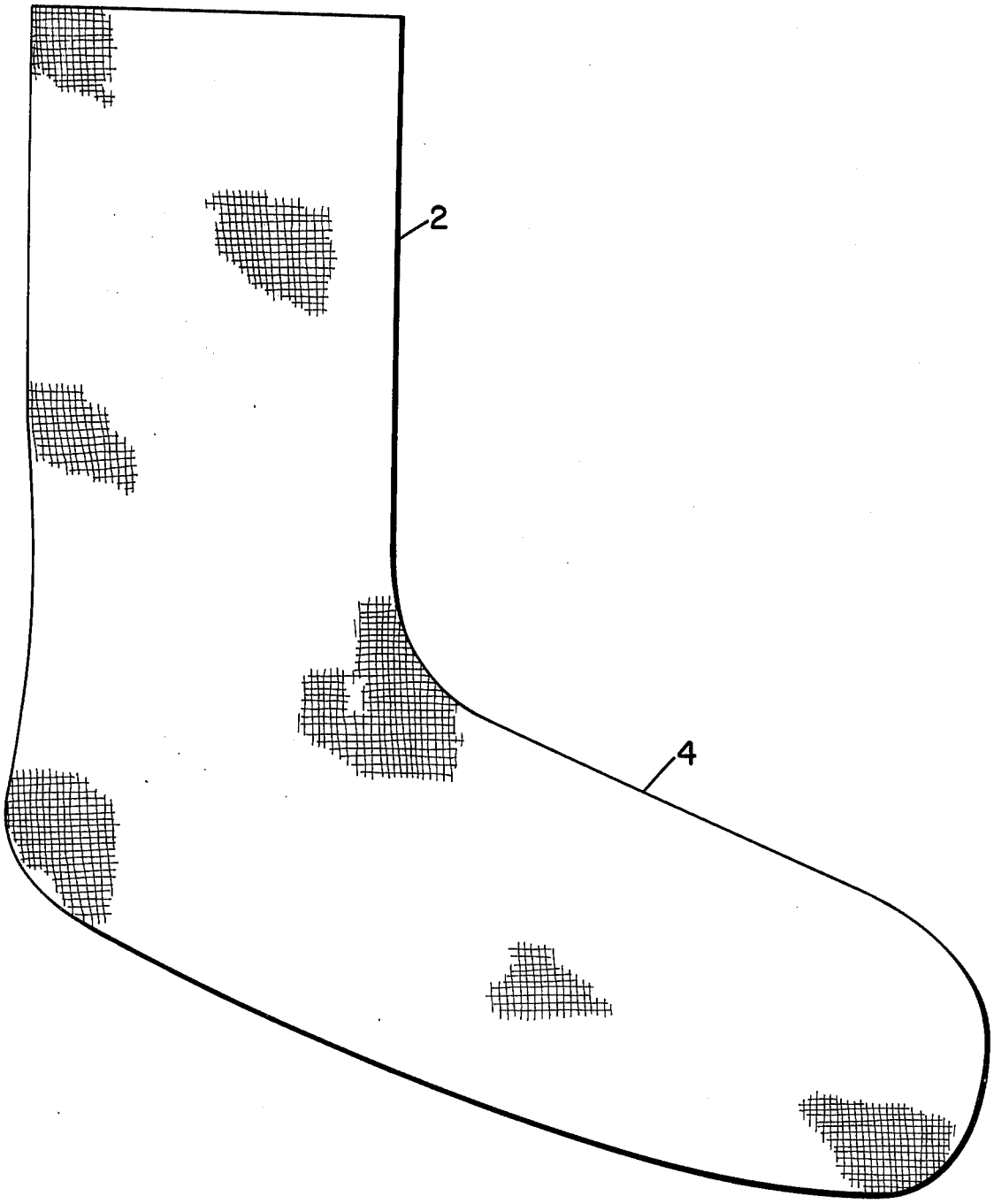
2
4

DEODORIZING MANUFACTURE FOR THE FOOT USING ION EXCHANGE MATERIAL

This is a division of application Ser. No. 382,208 filed Aug. 24, 1973, now U.S. Pat. No. 3,922,723.

BACKGROUND OF THE INVENTION

This invention relates to methods of deodorizing by the use of a particular ion exchange manufacture and more particularly to such methods using that ion exchange manufacture embodied in particular articles and to those particular articles.

The literature of the prior art, such as the reference book "Ion Exchangers in Organic and Biochemistry" by Calmon and Kressman, published by Interscience Publishers, Inc., New York, copyright 1957, records attempts at deodorizing by the use of ion exchangers. Typically, as for example, by Ikai in the Journal of Investigative Dermatology, Vol. 23, pp. 411 ff. (1954), such attempts were reported as employing ion exchange material in the categories of ion exchange resins ground into powders and used as powders, per se, or as powders mixed with a vehicle to constitute an oily or liquid preparation which was more or less sticky. The literature also reports attempted deodorizing by use of a catamenial pad having a cavity enclosing a quantity of bentonite, known to have ion exchange properties. U.S. Pat. No. 3,016,327 discloses biocidal compositions in which colloidal particles of anion exchange resin, described not as having any deodorant effect but only as the activating germicidal principle, are included in solid or liquid soap compositions, detergents, cosmetics, deodorants and the like.

For reasons clear from the following discussion, none of these prior art methods of deodorizing have proven practical. To deodorize an odorant involves rendering essentially imperceptible the odor from, or rendering negligible the disagreeableness of a malodor from, the odorant. To position, in contact with odorant emitted from a source, a quantity of ion exchange material sufficient to deodorize the odorant and to maintain that material in position to, and continuing to, deodorize for a period of time of practical length in those instances where the source continues to emit odorant, has not, with the forms of material used in prior art attempts at deodorizing, been possible to accomplish with efficacy, ease, comfort, and convenience of handling, positioning, and maintaining in position, nor with the ability to regenerate the material conveniently and economically in those instances where this ability would be especially desirable. That is, the prior art attempts at deodorizing with ion exchangers were not practically effective. Certain of the reasons for this will be apparent from the following exemplary discussion.

In attempts to deodorize the odorants issuing from the human axilla, finely powdered ion exchange resins were dusted thickly over the axillary skin. Obviously, a single grain or particle of such powder being exceedingly small, i.e. of negligible dimensions, rather than substantially extended would not deodorize effectively since it would not contain an appreciable number of ion exchange sites. The mass of powder, taken as a whole, being made up of a plurality of components grossly discernible as separate from one another, namely, the grains or particles, with each element free to move independently of its immediate neighbor essentially an indefinite distance apart from that neighbor, constituted a fluid. In other words, these components are, in normal use, dispersible. The deodorant effect of this fluid, i.e., the mass of powder, did not last long because of the washing away of the powder by sweat produced by the axilla and hence this method was impractical. In other words, in normal use, the ion exchange powder components are in fact dispersed by the washing away effected by the sweat and thus cannot and do not remain in contact with the odorant for a practical length of time.

When, in an attempt to improve adhesion of the material to the skin of the armpit, the powder was mixed variously with such vehicles as petrolatum, ointments, surface active agents, mucilages and mixtures thereof, the resulting products still remained fluid and suffered additionally from other disadvantages contributing to ineffective deodorizing such as blocking of the sweat from the resin by the hydrophobic petrolatum, lack of adhesion encouraged by some of the other ingredients, and uncomfortable sensation by the user.

In the case of the aforementioned catamenial pad, the amount of bentonite required even to approach adequate deodorizing of the user's excretion for a practical length of time rendered the pad impractically bulky. Furthermore, the mass of bentonite as a whole being fluid, it tended to run down to the lower end of the cavity in the pad and there accumulate as an inconvenient bulge.

As for the colloidal anion exchange resin particles of U.S. Pat. No. 3,016,327, reported only as germicidal and not deodorant, the disclosed embodiments all render them, in normal use, fluid and hence dispersible, as is seen from the following. Soap and detergents in solid form, i.e. cake or powder or chip, must, in normal use, to accomplish their intended function, be moistened with a liquid, typically water, and hence in normal use their ingredients are fluid. Liquid soap compositions and liquid detergents are obviously fluid. The colloidal resin particles embodied (for germicidal purposes only, according to the above mentioned patent), in cosmetics or deodorants constituted as pastes, or sticks which are in effect pastes, or liquids are obviously, in normal use, fluid and dispersible since the embodiments as a whole are fluid. Those masses of particles of resin which might be embodied in cosmetics or deodorants applied as powders are also, in normal use, fluid and dispersible, as previously pointed out in the discussion of powdered resins applied to the axilla.

An object of the invention is to provide, using particular types of ion exchange materials and more particularly certain articles embodying those materials, methods of deodorizing which are effective over a practical length of time, comfortable, convenient, and economical to use, and are especially applicable on the human body.

Another object of this invention is to provide those certain articles, embodying those particular types of ion exchange materials, especially useful in carrying out the methods of the invention.

Other objects and many of the attendant advantages of this invention will be apparent from the following description taken in connection with the drawing wherein the single FIGURE shows schematically a conventional article worn with a portion thereof normally in close juxtaposition to the foot of the wearer, namely a sock.

This invention comprehends the discovery that practical, effective deodorizing is accomplished by contacting an odorant with solid, substantially extended material endowed with anion exchange sites capable of sorbing anions from odorant at the pH existing in the region of contact, the material being, in normal use, essentially non-fluid and, essentially, non-dispersible, any components of the material that are endowed with anion exchange sites and are grossly discernible as distinct from one another being, when considered as a group, constrained against any significant flowing so that these components as a group exhibit the characteristic of being non-fluid and thus non-dispersible.

Since the concept of the invention involves the employment of anion exchange material which is non-fluid, and elements of which bearing ion exchange sites are, therefore, in normal use, essentially non-dispersible, it is apparent that in the practice of the method of the invention the ion exchange sites of the material can be held in contact with odorant for any desired practical length of time. For the same reason it is apparent that an article of the invention designed for one-time use will retain its ion exchange sites in the locations determined by the original placement of the article in use until the article is moved. Likewise an article of the invention designed for repeated use will thus remain intact in the sense that in normal use it retains all of its ion exchange sites since they are not dispersed.

The word "extended", as here applied to the forms of ion exchange material and as also used in the prior art (Calmon and Kressman op.cit.p.188), means having appreciable dimensions. It thus excludes forms such as particles, granules, grains of powder, etc. which are regarded as being of negligible dimensions. It includes such forms as rod, sheet, fiber, filament, roving, yarn, thread, sliver, linters, fabric, and the like, both when such items are intrinsically provided with ion exchange sites and when such items are provided with ion exchange sites essentially extrinsically. This latter situation is exemplified by constructions in which ordinary granular ion exchange materials or the like are retained by a base or substrate. The granules or particles can be affixed by, for example, gluing them to a sheet of any suitable substance such as paper, plastic, or cloth; they can be imbedded into a plastic matrix; they can be tethered to nappy fabric by gluing them to the projecting fibers or threads of the pile of the fabric; they can be tightly quilted into, or otherwise secured against flowing within, pockets or cavities in base material.

By describing the material, or those elements thereof which are endowed with ion exchange sites, as being essentially non-dispersible in normal use is meant that the portions of the material bearing ion exchange sites cannot in normal use flow or move indefinitely far away from one another, i.e. disperse. Of course, with any material subject to friction there will always be some minute rubbing off of part thereof as dust which can technically be named dispersion of the material as the dust particles scatter away from one another. Such attritive ablation, or dispersion, of the material of this invention is not required by, and hence not essential to, the material's normal execution of its intended function. The dispersion, if any, would be only incidental to the normal use of the material and would, in any case, involve an exceedingly minor amount of material. Thus, the material is fairly defined as essentially non-dispersible. In contrast, dispersibility is an atribute completely necessarily inherent in, implicit in, required by, and essential to the mechanism by which the soap in normal use carries out its normal function. The soap is obviously essentially dispersible since it is only by substantially unlimited separation of the particles of the soap from the cake and from each other, either by solution or by friction, that the soap can accomplish its normal use of being applied to a surface to be cleaned. The same characteristic of being essentially dispersible is obviously implicit in such items as conventional liquid, stick, and paste cosmetics and deodorants since it is only by dispersion that these materials can be applied in their normal use to a surface intended to be coated by them.

The invention additionally includes manufactures configured into shaped articles. To understand this part of the inventive concept it must be appreciated that a "shaped article" herein means an article fabricated for a particular use per se and shaped and finished in a manner to suit it to that use. It contrasts with and excludes, in general, material in bulk whose usual "use" is only to be subdivided into smaller portions (dimensioned for the proper size of a contemplated shaped article) to be fabricated, shaped, and finished into "shaped articles". Thus, for example, sheeting is bulk material whereas "a sheet", in the sense of an item of bedclothes, is a "shaped article", having been cut from the sheeting to shape it to the dimensions of a particular size bed and finished as by hemming. Likewise a bolt of cloth is bulk material whereas a washcloth made from the cloth is a "shaped article" having been shaped, by cutting it to proper size from the bulk cloth, and, typically, finished as by hemming or taping the edges. Within the purview of the invention, the shaped articles of the invention are further limited to the type which are normally placed in contact with, or juxtaposed to, an odorant to be deodorized, as contrasted with bulk material such as sheeting or a bale of linters which only by sheer accident would find themselves in contact with odorant to be deodorized.

Having thus defined these terms, it is now stated that the invention further comprehends manufactures, especially adapted to carry out the methods of the invention and defined as configured into shaped articles comprising this aforementioned material and normally juxtaposed to either a primary source of odorant or a secondary source of odorant or both with anion exchange material in contact with odorant and typically the articles being ordinary articles of commerce or substantial copies thereof used to accomplish their usual prior art functions and altered only in that they have components endowed with active ion exchange sites. This aspect of the invention involves the realizations that ion exchange is subject to the law of mass action; that all odorants in a livable environment are present in only very high dilutions; and therefore even an odorant substance that exhibits only a very low affinity for a particular ion exchanger will be quantitatively sorbed when the gas carrying it contacts the ion exchanger. Economically and conveniently the invention thus typically achieves, without the need for a separate deodorant article or substance, the important feature of deodorizing as a new additional function incident to the ordinary use of an ordinary article of commerce while accomplishing its ordinary intended prior art functions, and this without the need for essentially any gross structural changes to the article of a major or intolerable nature. Within this defined class of manufactures of the invention is a preferred group of articles especially useful: those articles normally juxtaposed to a body and in contact with odorant when so juxtaposed.

As used herein, a primary source of odorant means one where the odorant is either inherent or is, in effect, being generated. Examples are a substance, such as butyric acid, that by nature exhibits an odor and an infected wound where odorant is being generated from normally relatively odorless tissue by decomposition or other chemical action. As used herein a secondary source of odorant means an odoriferous region of atmosphere immediately adjacent to, and disposed to flow into, or out of, a confined space. An example is odoriferous air which enters a window or duct leading into a room, building, chamber or the like, or which enters the respiratory passages of an animal or human. As used in the context herein-above, "normally" juxtaposed means that for the purpose of carrying out its customary intended functions and/or when carrying them out, the article is juxtaposed as indicated.

Since typically, the invention contemplates the convenient, economical, regeneration of the ion exchange sites used in the articles of the invention, the invention involves the use of weak base anion exchangers as a preferred group. These can be regenerated conveniently and inexpensively and without undue hazard requiring special precautions or commercial facilities since all that is required to regenerate them is ordinary soap, or detergent, or any other substance which, as they do, gives a basic reaction to litmus.

From another point of view the invention comprehends practical articles of wear (including, especially, articles of wearing apparel) fabricated of components comprising anion exchange material such, for example, as aminated cotton (also sometimes called aminized cotton). Within this concept of the invention is the discovery that such articles embodying such anion exchange material, although typically constructed in the same configurations in which they customarily appear in the prior art made of cotton or other usual fabrics will, without the need of additional material causing undesired bulkiness, provide enough anion exchange sites to deodorize for a practical length of time. Also within this concept of the invention is the discovery essential to a practical innovation, that such articles comprised of aminated cotton, which substance is already known in the prior art in various raw material forms (e.g. Textile Research Journal, Vol.23, p.523ff. and p.527ff.) can be quite easily adequately washed (and simultaneously regenerated) by commonly used laundering processes, although to fabricate with aminated cotton such articles, which are typically made of materials specially selected to resist soiling and wash easily, is directly contrary to the teaching of the prior art that aminated cotton is more easily soiled and retains soil more tenaciously than ordinary cotton. The invention includes the realization, confirmed by repeated tests, that to achieve wholly satisfactory cleaning of the typically reusable articles of the invention by even such simple laundering as washing by hand or in a home type washing machine it suffices merely to insure that the soap or detergent used is selected from the commonly available group that is at least weakly alkaline.

Further to complete the notion of the practicality of these articles, the invention comprehends the discoveries that such articles comprised of material such as aminated cotton exhibit an acceptable hand and tests have failed to show any reduction in the lives of these articles when subjected to normal usage and washings as compared to the lives of similar articles comprised of ordinary cotton.

DESCRIPTION OF THE PREFERRED EMBODIMENTS

Methods of the Invention

In carrying out the contacting of odorant with anion exchange material to deodorize according to the invention, several methods are involved, each being applicable to its respective situations.

Deodorizing is accomplished by juxtaposing an article of the invention embodying the anion exchange material used in the invention to a source of odorant so that the anion exchange material is in contact with the odorant. A primary source of odorant would be, for example, the body of an animal, such as a dog, or the body of a person, either of which may typically exude odorant, due quite commonly to excretions. Other primary sources would be, for example, fish, onions, and garbage. A secondary source of odorant would be, for example, the atmosphere or air which carries the odorant from, typically, a primary source. In case the source of odorant is a body, the juxtaposition is done by the use in the normal manner of such items as bedclothing (e.g. sheets, pillow cases, blankets), upholstery and furniture slip covers comprising the ion exchange material so that the items readily contact odorant exudate of the user and deodorizing is achieved by pickup of anions from the odorant by the ion exchange material. Also, this juxtaposition can be done by the use, in the normal manner, namely the wearing by the odoriferous body, of wearable articles comprising the ion exchange material. Wearable articles are not only those items conventionally regarded as wearing apparel but also include other articles hereinafter illustrated by examples, worn so as to contact odorant emitted by the wearer. Especially important is the wearing of wearable articles which contact odorants most noticeable to humans, e.g. those emanating from the human axillae, feet, and crotch.

In the case of an odorous substance being considered the primary source of odorant as, for example, fish, onions, and garbage, the juxtaposition can be achieved by enclosing it in the ion exchanger material as by wrapping it in ion exchange wrapping paper or plastic wrap or closing it up in a bag made of the ion exchange material. This method of deodorizing is also significant in preventing the uptake of odorant from an odoriferous substance by other substances such, for example, as foods, located nearby.

In the case of such a primary source as food in a cooking utensil, for example, the juxtaposition involves placing on the untensil a lid embodying the ion exchange material such as aminated cotton. This serves to deodorize such malodorous emanations as those, believed due to sulfur, arising during the cooking of, for example, cauliflower and cabbage.

Especially when it may not be practical to deodorize at the primary source of odorant, the invention involves deodorizing by juxtaposing an ion exchange material to the secondary source, i.e. that region of the odoriferous atmosphere which would carry the odorant into a confined space such as a room, tent, chamber, or the nose of a recipient. Thus, for example, the ion exchange material of the invention can be embodied in a screen or filter and placed to filter the atmosphere entering through a window, duct or the like of a room or building where deodorizing is desired. Similarly the deodorizing can be accomplished by juxtaposing the ion exchange material to the nose of the recipient of the atmosphere by embodying it in a breathing mask, such, for example, as a surgical mask worn by the recipient. If the breath of a wearer of such a breathing mask constitutes a primary source of odorant, then the wearing of the mask deodorizes this source and the method of the invention being practiced is essentially the same as with the aforementioned wearing of apparel embodying the ion exchange material. If, simultaneously, the mask wearer is in an odoriferous ambient atmosphere and if his own breath is odorous, then the mask is seen to be simultaneously juxtaposed to both a primary and a secondary source of odorant.

The ion exchange material used according to the invention is itself maintained deodorized as well as deodorizing the odorants it contacts. Thus, embodying the ion exchange material in such articles as collars, combs, and hairbrushes, which tend to pick up odors and remain odorant when placed in contact with odorants emitted by persons or animals on which the articles are used, serves to deodorize the articles and maintain them deodorized.

Wiping or scrubbing such odorous sources as knives and cutting boards recently used for fish, onions, etc., with a dishcloth, washcloth, paper or cloth towel, or the like embodying the ion exchange material achieves the contacting with the odorant required to deodorize.

Regeneration of the ion exchange material, when appropriate, can be done using well-known prior art teaching in any convenient way. With the exception of those articles typically discarded after a single use, such as wrapping paper and garbage bags, the articles of the invention used in carrying out the methods of the invention can, for example, be simply laundered with ordinary alkaline soap or detergent available on the home market to regenerate the ion exchange sites occupied by the sorbed odorant anions so that these sites will again be available for deodorizing.

Articles of the Invention

The articles of the invention, as previously suggested, are defined as deodorant articles comprising anion exchange material and normally juxtaposed to a source of odorant of at least secondary status with said ion exchange material in contact with the odorant, the anion exchange material being in non-fluid, substantially extended form and having anion exchange sites capable of substantially sorbing anions from the odorant at the pH existing in the region of contact between the material and the odorant, any components of the material that are endowed with anion exchange sites and are grossly discernible as distinct from one another being, when considered as a group, constrained against any significant flowing so that these components as a group exhibit the characteristic of being non-fluid. An especially preferred group of the articles of the invention is those articles normally juxtaposed to a body human or animal, and in contact with odorant when so juxtaposed.

Particularly significant among the articles of the invention are articles applicable to a body and hence most are normally juxtaposed to a primary source of odorant. Included in this category are such articles as combs and brushes, typically having transient association with the body, as well as, by way of example only: articles of bedclothing such as blankets, sheets, pillow cases, mattress pads, and the like; articles of wear or attire; articles used for wiping (both bodies and other sources of odorant) such as dishcloths, washcloths, towels, etc.; and articles used to enclose, envelop, or contain, such as bags, wrappers, and the like.

Articles of wear or attire include those articles usually designated as wearing apparel and also those other wearables which may be called accouterments. By way of example only, certain articles are listed hereinafter. Among accouterments are, for example, suspenders; garters; catamenial pads or devices; diapers; veils; breathing masks such as surgical masks; belts, including sanitary belts; athletic supporters; wristwatch bands; neckwear, including scarfs (sometimes worn also on the head) and neckties; sweatbands, typically used by sportsmen, chefs and others exposed to profuse perspiration on the wrist, arm, head, etc.; toupees, wigs, and hairpieces; underarm sweat shields, commonly called dress shields; sanitary panties and shields, including such items as skirt shields chafe guards; gloves; wallets and pocket purses. Articles of wearing apparel include garments, footwear, and headgear. Of garments, typically undergarments are those worn usually next to the skin and include: underwear, both the one-piece type and the two-piece type, which latter has drawers, pants, panties, shorts, or briefs and jackets, vests, undershirts, and the like, especially T-shirts; corsetry, including brassieres, braslips, girdles, corsets, panty girdles; leotards, tights, and pantyhose. Examples of other articles of wear often, if not always, worn next to the skin are: slips; nightclothes, including nightgowns and pajamas; shirts, dresses, blouses, skirts, sweaters, sweatshirts, coats, jackets, trousers; and hosiery, including socks and stockings. Examples of footwear are canvas shoes, commonly called tennis shoes or sneakers, shoes of other materials; and insoles, shoe linings. Examples of headgear include: caps and hats, and sweatbands in these articles.

Also significant among the articles of the invention are a pot or pan lid embodying, for example, aminated ion exchange cotton, fashioned, for example, analogously to, or in combination with, the well-known mesh of a common anti-splatter lid and used for deodorizing the odorant arising from the cooking of cauliflower, cabbage, fish, etc.; items used for wiping odorous surfaces such as dishcloths, washcloths, and towels; and items used for enclosing odorous substances such as wrapping paper or wrapping plastic, envelopes, and bags. Articles in these categories also are thus normally juxtaposed to a primary source of odorant. Typically these articles are juxtaposed to the body of a user when the user is wiping an odorous surface, wrapping or enclosing odorous substances or transporting a wrapped or enclosed odorous substance.

Among those articles of the invention principally regarded as normally juxtaposed to a secondary source of odorant are screens and filters for windows, ducts, and the like for contacting odoriferous atmosphere entering or leaving a room, chamber, or the like; and breathing masks and veils which perform the same function as regards the nose of a wearer. These latter are also, of course, normally juxtaposed to the body of the wearer.

Especially important embodiments of the articles of the invention applicable to a body are those which in use are in contact with odorant from a region of the body that commonly exudes an odor relatively strongly noticeable to humans, e.g. the axilla, crotch, and foot and a festering wound or the like. These embodiments, by way of example only, obviously include one-piece underwear, undershirts, and the like; dress shields, shirts, sweaters and blouses, dresses, certain corsetry, certain nightclothes, and the like having a region close to the armpit; underpants, tights, leotards, pantyhose, sanitary panties and shields, catamenial devices, and shorts and briefs; hosiery and footwear; gauze bandages and similar medical dressings.

According to the invention, the articles of the invention comprise the above-described anion exchange material chosen in species adapted to the article which is to embody it. These species and the methods of manufacturing them do not form part of this invention but are adapted from the prior art. Because it is simple and relatively inexpensive to make, anion exchange cotton, such as described, for example, in the article by Guthrie entitled "Ion Exchange Cottons" in Industrial and Engineering Chemistry, Vol. 44, p. 2187, Sept. 1952, is a preferred substance for use in many of the articles of the invention. Particularly preferred is aminated cotton (called aminized cotton in that article) since it quite adequately performs the desired functions and is easier to make than, for example, aminated-iminated cotton (called aminized-iminized cotton in that article) and more readily regenerated than, for example, quaternary aminated cotton (called in that article quaternary aminized cotton). More detailed instructions for the making of such cotton than those in the aforementioned article appear in, for example, the Textile Research Journal, Nov. 1947 beginning on page 625, under the title "Introduction of Amino Groups into Cotton Fabric by use of 2-Aminoethylsulfuric Acid" by Guthrie. Other substances that can be similarly endowed with anion exchange sites by known methods are, for example, paper pulp and finished paper, many synthetics such as polystyrene or nylon or viscose rayon, the activation of which latter with ion exchange sites is described in the last-cited publication. For making such articles as combs and bristles of brushes and the like, synthetics such as activated polystyrene or the like are used. For typical wearing apparel articles and wiping or scrubbing articles fabrics comprising activated cotton or the like are used.

For wrappers and bags and envelopes activated paper or plastic are used. These latter would be made in the manner of the prior art to be essentially imperforate and relatively non-porous so as to adequately retain such odorant substances as moist garbage, fish, etc.

To meet the criteria of the invention the material must be capable of substantially sorbing anions of odorant at the pH existing in the region of contact between the material and the odorant. The pH requirement means, for example, that if cotton is aminated and then dyed with a type of acid dye that is strongly bound to, and thus occupies, essentially all the active anion exchange sites, these sites would not be available at the pH of human perspiration, for example, to sorb the anions of the perspiration odorants. To render such dyed cotton useful in the invention it would simply have to be reprocessed after dyeing (i.e. aminated again) to endow it with additional anion exchange sites free of the dye and hence available for anion exchange action at the pH of perspiration.

The requirement for substantial sorption of anions means that enough anion exchange sites are available to achieve deodorizing of the intended odorant for a practical length of time before the active ion exchange sites are exhausted and the article must be discarded or the sites regenerated. In the practice of the invention the determination of what constitutes a practical length of time becomes readily apparent from the nature and use of the article under consideration. For example, underwear such as a T-shirt would typically be expected to be worn for a day or two before laundering and such a length of time would thus be desired as practical for it to deodorize the perspiration odorant it is intended to sorb. On the other hand a dishcloth or the like is usually usually used to wipe or scrub odorous surfaces for a period of only minutes, if not just seconds, before it is subjected to a soapy rinse which will regenerate it and thus a practical length of time for such an article to be expected to deodorize the food odorants etc. for which it is intended before all its ion exchange sites are exhausted need be no more than minutes.

In the case of an article comprising material not made of separate strands or fibers, such as plastic sheet, it is usually practical to endow the entire material with active ion exchange sites although the article may not require such a profusion for its expected use. Although in the case of a fabric article, for example, it may be convenient to endow the entire fabric with anion exchange sites, it is often possible to achieve adequate deodorizing with fabric made of a mixture of anion-exchange-site strands or fibers and other strands of fibers which are not activated or indeed may be endowed with cation exchange sites. Cation exchange cottons are described in "Phosphorylated Cotton Cellulose as a Cation-Exchange Material" by Jurgens, Reid and Guthrie, in the Textile Research Journal, January 1948, pp.42–44, and "Studies on the Partial Carboxymethylation of Cotton" by Daul, Reinhardt, and Reid in the Textile Research Journal, Dec. 1952 pp. 787–792. Also substantial sorption can be achieved with a wiping or scrubbing article structured similar to the well-known pot cleaner "Golden Fleece" and thus having granules of anion exchange resin or plastic tethered to an unactivated nappy cloth base by gluing or otherwise affixing them to the ends of the pile loops, for example, of ordinary terry cloth. Such an article further illustrates conformance with the definition of the invention: although the individual resin particles constituting distinct components endowed with active sites can move to some extent by virtue of their tethering, they cannot, as a group, flow.

Differing from them only by virtue of being endowed with the anion exchange sites required in the practice of the invention, the types of substances used to comprise the respective articles are generally similar to the substances used conventionally to make the articles when the latter are not deodorizing, typically:felted fabric for some hats, knitted fabric for undershirts, woven fabric for some shirts, non-woven fabric for some wiping cloths, paper or woven cloth for towels. In the case of suspenders, for example, there is typically elastic material, such as rubber, covered by cotton, for example. By endowing this cotton covering with anion exchange sites the suspenders can be deodorized and maintained deodorized against the odorant from perspiration for a practical length of time and thus constitute a deodorant article. In like manner combs and hairbrushes of activated nylon, for example, deodorize themselves from body odorant they tend to pick up in normal use. A catamenial device can comprise, for example, cotton in the form of bulk cotton, padding or linters enclosed in a fabric wrapping. The nature of the fibers prevents any flowing of material. Any or all of the components can be activated, i.e. endowed with anion exchange sites. Also a catamenial device can comprise, for example, anion resin exchange powder or granules tightly quilted into pockets of a base fabric which may itself, but need not, be activated. The tight quilting prevents flow of the resin. Window screens, filters for air ducts, and the like can be made of, for example, synthetics such as polystyrene activated not only with anion exchange sites but also cation exchange sites to achieve more effective deodorizing in some situations. Wrappers, envelopes and bags can typically comprise materials such as more or less conventional relatively non-porous wrapping paper or plastic sheeting endowed in each case with anion exchange sites by any convenient process known in the art (e.g. Calmon and Kressman op. cit. Chaps. 9, 30). The substances used in components of the article of the invention can generally be endowed with active ion exchange sites while in their crude or raw material form, e.g. fibers, thread, yarn, or while in their partially finished form, e.g. cloth, or when in their final form in the article itself.

Following are several specific examples of the practice of the invention.

One item in the category of articles worn with a portion thereof in close juxtaposition to the foot of the wearer is a conventional sock. As is well known, but nevertheless shown in the drawing to facilitate envisioning it, a sock includes an upper portion 2 engaging the leg of the wearer and a lower portion 4 which presents an effective material surface in contact with a large percentage of the surface area of the foot when worn by the wearer of the size for which the sock is intended and which is adapted to contact odorant emitted by the foot. The following Example describes socks made to constitute an article of the invention and describes the use of the socks to carry out the method of the invention.

EXAMPLE 1

A pair of non-mercerized cotton socks were immersed for about five minutes at room temperature in a solution of 25 percent sodium hydroxide and 10 percent 2-aminoethylsulfuric acid, baked for 40 minutes at 208° F. and washed in plain water through two cycles of a home washing machine. One of these socks was worn on one foot by a test subject suffering from foot perspiration and odor while a non-treated control sock was worn on the other foot. Examination carried out every two hours revealed that while perceptible odor was present after the first two hours in the control, no odor was detected even after sixteen hours in the shoe or on the sock or foot in the case of the treated sock. The treated sock was then laundered in a home washing machine using an ordinary commercially available detergent providing an alkaline solution containing $Na^+$ and $CH^-$ ions.

The experiment was repeated for thirty days with daily launderings of the socks and with the same result. Subsequently the daily wearing and laundering of both treated socks was undertaken. Tests over a prolonged period of time have failed to show any diminution in the deodorizing effectiveness of the treated socks nor any evidence of abnormal deterioration of wear of the fabric of the treated socks indicating any shorter wearing life for the treated socks compared with the normal wearing life of their untreated counterparts.

Perhaps the most widely emphasized source of odorant for which deodorizing is sought is the human axilla. For achieving this deodorizing this invention includes a class of garments comprising anion exchange material and characterized in that they are fabricated and configured so that when they are normally worn the anion exchanger material of the garment contacts the odorant from the axilla, typically because the garment is worn next to the body so that the garment anion exchanger material is in direct contact with the axilla. The ideal situation is for the anion exchanger material to be in direct contact with the entire area of the axilla from which odorant is exuded. This can be accomplished if a portion of the garment is placed in contact with, and spans the entire area of the axilla during the wearing of the garment and this material is essentially imperforate, such as plastic sheeting. However, an adequate result can be obtained if the material, being not imperforate, exhibits a relatively tight or close mesh or weave such as is common among such diverse garments as knitted T shirts and woven outer shirts. A garment which will deodorize the axilla must, in order to achieve the aforementioned contact with odorant, be configured so that the body portion of the garment has high enough armholes that the region of the body portion of the garment adjacent to, and in part forming the boundary of, the armholes and, if the garment has sleeves, that region of the sleeves adjacent to the armholes where the sleeves join the body of the garment normally contact the axilla of the wearer of the garment when the garment is worn by a wearer of the size for which the garment is intended.

Typically to insure contact of the anion exchanger material with the entire odorant-emitting area of the axilla the garment would be one which provides a snug fit of close mesh fabric or the equivalent in direct contact with the entire area of the axilla during entire normal wearing of the garment. This normally implies a garment with sleeves. Examples of such a garment usually worn next to the body are union suits, with either short or long sleeves, long or short sleeve undershirts of the type commonly worn with drawers (often as thermal underwear), and ordinary conventional T shirts, which have short sleeves. The muscle shirt and the sleeveless T shirt both usually have a high enough armhole (and sometimes appear to have even what might be called a rudimentary or vestigial sleeve) so that they present some material in contact with the axilla. All of the aforementioned are standard, commonly-marketed items such as shown, for example, in the current Montgomery Ward catalog for western U.S.

Not useful for axillary deodorizing would be the conventional athletic undershirt distinguished by a deep armhole presenting, in normal use, no material in contact with the axilla. The effective surface area of the axilla-contacting material is the surface area of the solid matter of the material, e.g. the threads or fibers, in contact with the axilla and not the holes or gaps in the weave or mesh. Thus the net-type undershirts exemplified by the Norwegian string undershirt generally do not meet the criteria of the invention because the net-type material used in them does not present sufficient effective surface of material in contact with the axilla to deodorize effectively inasmuch as the mesh of the material is too coarse or open.

There is considerable variety among individuals as to the profuseness and odoriferousness of perspiration. There is also considerable variety of these characteristics with the same individual under different circumstances. Because of the variety it is impossible to determine the minimum requirements under all conditions for the axillary contact portion of a satisfactorily deodorizing garment. However, the invention comprehends garments of such a configuration that they present anion exchanger material in contact with a substantial portion of the axillary surface, typically achieved by means of a high armhole and, most commonly, with sleeves in addition. The garment must also present an effective surface area of that portion of the anion exchanger material of the garment which contacts the axilla sufficiently large to contact a substantial portion of the area of the axilla which exudes odorant, this being achieved by making that axilla-contacting portion of the garment either of imperforate material or of knitted or woven material or the like of relatively tight weave or close mesh, such as typically found, for example, in a conventional T shirt or a broadcloth outer shirt.

It should be noted that although snug-fitting, sleeved garments which provide essentially constant contact of their material with the axillary surface during all normal attitudes of the wearer certainly serve the purpose excellently, nevertheless effective deodorizing can be achieved with garments providing somewhat intermittent contact of their material with the axilla. For example, a certain T shirt has been found effectively deodorant for a certain wearer even though its armholes and those portions of the sleeves adjacent to the armholes are so large relative to proximal section of upper arm of that wearer that axillary contact of the shirt material occurs only when the upper arm is adducted and not when it is abducted.

Other garments meeting the criteria of the invention are too numerous to record and are self-evident in view of the ease of testing them against the criteria. Obviously included are garments customarily worn as outer garments (some of which are so named simply because they are socially acceptable when worn in public view), but frequently worn so as to present material in contact with odorant emitted from the axilla either because they are worn with no undergarment beneath them; or because the undergarment worn beneath them itself has because of its configuration, little or no axillary-contacting material and therefore allows direct contact of the outer garment with the axilla; or because of the fit and material of the undergarment and the fit of the outer garment the odorant from the axilla is caused to permeate to and contact the outer garment. Obviously included in garments meeting the inventive criteria are T shirts designed to be and worn as outer garments with no undergarment, polo shirts, ordinary woven and knitted shirts, sweaters, sweatshirts, jackets, various uniforms, both civilian and military, blouses, robes, bodices and coats.

A conventional T shirt, i.e. a T shirt with obvious short sleeves, quite apparently more than meets the aforementioned two criteria for an axillary-deodorizing article of the invention. As is well known, the region of the body portion adjacent to the sleeve and region of the sleeve adjacent to the body portion, the former serving to form the armhole and the latter being usually sewn to the body portion along the boundary of the armhole, combine to present an effective material surface in contact with essentially 100% of the axilla when normally worn by a wearer of the size for which the garment is intended. Thus the ordinary T shirt easily meets the requirement for contact over a substantial portion of the odorant-emitting axillary area. Because of the closeness of the normal, ordinary T shirt knit the criterion for effective surface area of material contact is also easily satisfied. The T shirt is hence chosen as another example.

EXAMPLE 2

A man's ordinary T shirt undergarment was made into an anion exchanger in the same manner as described in Example 1. Under conditions producing profuse sweating it was worn by a subject whose axillary regions habitually produce prominent odor. Not until after three days of wearing the undershirt did axillary perspiration odor start to become perceptible from the body and on the garment. The T shirt was washed by hand in ordinary alkaline detergent solution as in Example 1 and tested again in the same way with the same result. Continued prolonged use of the garment with laundering following each two-day wearing period has failed to reveal any diminution in deodorizing effectiveness or any evidence of wear at a faster rate than that of similar untreated T-shirts.

According to the earlier mentioned article by Guthrie in Industrial and Engineering Chemistry of September 1952, aminated cotton exhibits an anion exchange capacity of 0.6 meq. per gram. Since the conventional aforementioned T shirt and socks effectively deodorized for a practical length of time, it appears that the ordinary knit of these items provides sufficient material in contact with the odorant to provide enough ion exchange sites to accomplish the desired deodorizing when the anion exchange capacity of the material is of the order of 0.6 meq. per gram. The same can be said for the towel, cheesecloth and insole cloth hereinafter described.

EXAMPLE 3

A cotton towel was made into an anion exchanger in the same manner as described in Example 1. It was then used to wipe water-wetted hands soiled with sardine oil. Olfactory examination of the wiped hands revealed absence of odor. The same experiment was repeated with hands soiled with onion and garlic and the same results were obtained.

EXAMPLE 4

A surgical mask was fashioned from layers of aminated cheesecloth. The mask was worn and the atmosphere over open bottles of butyric acid, feces, crushed garlic, and parboiled cabbage was sniffed. No odor was detected.

EXAMPLE 5

A sandwiched shoe insole was fashioned from layers of anion and cation exchange cloth made, respectively, of aminated cotton and partially carboxymethylated cotton. This insole was placed in one shoe of a pair and, as a control, an insole of untreated layers of cotton was placed in the other shoe of the pair. The shoes were worn by a subject who wore ordinary untreated socks and whose feet characteristically produced noticeable malodor. At various intervals the feet, shoes, and insoles were smelled. No malodor was detected on the treated insole nor on the foot or shoe associated therewith, whereas the malodor was readily apparent on their control counterparts. The deodorant capability lasted for from two to three days after which the treated insole was regenerated by ordinary laundering restoring the ion exchangers to the $Na^+$ and $OH-$ forms.

From the foregoing it is apparent that the articles of the invention endowed with active ion exchange sites are applied to their normal use in the same manner as their un-endowed counterparts and deodorize incident to their other usual functions. Ordinary laundering with common alkaline detergent or soap serves the usual purpose of cleaning those anion exchange articles normally washed and re-used and simultaneously regenerates the exhausted anion exchange sites. Those articles such as window screens, endowed with both anion exchange sites and cation exchange sites, are regenerated by rinsing with solutions containing NaOH, $Na_2CO_3$, or $NaHCO_3$, or the like.

What is claimed is:

1. A deodorant manufacture configured into a shaped article of the category customarily worn on the foot;

said article comprising anion exchange material and the configuration of said article, when worn in the normally intended manner, being such that a portion of the material of the article is in close juxtaposition to the foot of the wearer;

the effective surface area of said portion of the material of the article being sufficiently large and so located that it covers a substantial portion of that area of the foot which exudes odorant and said portion of the material of said article including anion exchange sites; and said anion exchange material being in non-fluid and essentially non-dispersible, substantially extended form and having anion exchange sites capable of substantially sorbing anions from said odorant at the pH existing in the region of contact between said material and said odorant;

any components of said material that are endowed with anion exchange sites and are grossly discernible as distinct from one another being, when considered as a group, constrained against any significant flowing so that these components as a group exhibit the characteristic of being non-fluid and essentially non-dispersible.

2. The manufacture of claim 1 wherein said article is hose.

3. The manufacture of claim 2 wherein the material comprises weak base anion exchange fabric.

4. The manufacture of claim 3 wherein said fabric comprises aminated cotton.

5. The manufacture of claim 1 wherein the material comprises weak base anion exchange fabric.

* * * * *

UNITED STATES PATENT AND TRADEMARK OFFICE

CERTIFICATE OF CORRECTION

PATENT NO. : 4155123

DATED : May 22, 1979

INVENTOR(S) : Karel Popper

It is certified that error appears in the above—identified patent and that said Letters Patent is hereby corrected as shown below:

Column 11, line 53, change " $CH^-$ ions" to --- $OH^-$ ions ---.

Signed and Sealed this

Twenty-sixth Day of February 1980

[SEAL]

Attest:

SIDNEY A. DIAMOND

Attesting Officer

Commissioner of Patents and Trademarks